US011578598B2

(12) United States Patent
He et al.

(10) Patent No.: US 11,578,598 B2
(45) Date of Patent: Feb. 14, 2023

(54) METHOD FOR COAL MINING WITHOUT RESERVING COAL PILLAR AND TUNNELING ROADWAY IN WHOLE MINING AREA

(71) Applicant: Beijing Zhongkuang Innovation Alliance Energy Environment Science Academy, Beijing (CN)

(72) Inventors: Manchao He, Beijing (CN); Yubing Gao, Beijing (CN); Qiang Fu, Beijing (CN); Yajun Wang, Beijing (CN)

(73) Assignee: Beijing Zhongkuang Innovation Alliance Energy Environment Science Academy, Beijing (CN)

( * ) Notice: Subject to any disclaimer, the term of this patent is extended or adjusted under 35 U.S.C. 154(b) by 0 days.

(21) Appl. No.: 17/597,481

(22) PCT Filed: Jul. 22, 2019

(86) PCT No.: PCT/CN2019/097066
§ 371 (c)(1),
(2) Date: Jan. 7, 2022

(87) PCT Pub. No.: WO2021/003772
PCT Pub. Date: Jan. 14, 2021

(65) Prior Publication Data

US 2022/0251953 A1 Aug. 11, 2022

(30) Foreign Application Priority Data

Jul. 9, 2019 (CN) ..... 201910616056.2

(51) Int. Cl.
*E21C 41/00* (2006.01)
*E21C 41/18* (2006.01)
*E21D 9/14* (2006.01)

(52) U.S. Cl.
CPC ..... *E21C 41/18* (2013.01); *E21D 9/14* (2013.01)

(58) Field of Classification Search
CPC ..... E21C 41/18
See application file for complete search history.

(56) References Cited

U.S. PATENT DOCUMENTS 3,999,804 A * 12/1976 Simpson ..... E21C 41/18 299/11
4,174,135 A * 11/1979 Grenia ..... E21C 41/00 299/11

(Continued)

FOREIGN PATENT DOCUMENTS

CN 102392642 A 3/2012
CN 105089668 A 11/2015

(Continued)

OTHER PUBLICATIONS

Guo, W.C., Wu, C.: Comparative study on coal mine safety between China and the US from a safety sociology perspective. Procedia Eng. 26, 2003-2011 (2011) 6 (Year: 2011).*

(Continued)

*Primary Examiner* — Janine M Kreck
(74) *Attorney, Agent, or Firm* — ArentFox Schiff LLP

(57) ABSTRACT

A coal mining method is provided without coal-pillar leaving and without laneway excavation in a full mining area. The coal mining method includes drilling a main shaft, an auxiliary shaft and a return air shaft from a ground to a coal mining layer; by a coal mining machine, forming a first mining face with a first direction as an advance direction; by the coal mining machine, cutting out a first haulageway and a first return airway while cutting the coal wall at the first mining face, and preserving the first haulageway and the first return airway. In this method, the first haulageway and the first return airway are located on two sides of the first mining (Continued)

face, the first haulageway is in communication with both of the main and auxiliary shafts, and the first return airway is in communication with the return air shaft.

8 Claims, 3 Drawing Sheets

(56) References Cited

U.S. PATENT DOCUMENTS 4,378,132 A * 3/1983 Spies ..... E21C 41/18 299/11
10,494,924 B2 12/2019 He

FOREIGN PATENT DOCUMENTS

CN 105240013 A 1/2016
CN 106121646 A 11/2016
CN 109209382 A 1/2019
EP 2801697 A1 11/2014
GB 2109035 A 5/1983
GB 2229747 A 10/1990
WO 2019/109602 A1 6/2019

OTHER PUBLICATIONS

37 CFR 75.350, printed Jul. 2022 (Year: 2022).*
China National Intellectual Property Administration, International Search Report and Written Opinion dated Apr. 8, 2020 issued in PCT Application No. PCT/CN2019/097066.
China National Intellectual Property Administration, First Office Action issued in Chinese Patent Application No. 2019106160562.2.
Supplemental European Search Report, dated Aug. 9, 2022, issued in corresponding European Patent Application No. 19936877.

* cited by examiner

METHOD FOR COAL MINING WITHOUT RESERVING COAL PILLAR AND TUNNELING ROADWAY IN WHOLE MINING AREA

CROSS-REFERENCE TO RELATED APPLICATIONS

This application is a National Phase of PCT/CN2019/097066, filed on Jul. 22, 2019, which claims priority to Chinese Patent Application No. 201910616056.2, filed on Jul. 9, 2019, the disclosures of each of which are hereby incorporated by reference in their entireties.

TECHNICAL FIELD

The present disclosure relates to the technical field of mining, and particularly relates to a coal mining method without coal-pillar leaving and without laneway excavation in a full mining area.

BACKGROUND

Conventional modes of exploitation and laying-out for coal mining require to, when a coal bed is exploited, firstly excavate at least 3 main exploitation laneways, to serve the entire mining area, and subsequently excavate at least 3 laneways from the main exploitation laneways into the mining areas, to serve each of the mining areas. Inside the mining areas, for each of the working faces, it is required to excavate out in advance two laneways as a working-face haulageway and a working-face return airway, to serve the working face. In order to enable each of the stopping working faces to normally connect, one coal mine is required to be provided with a plurality of excavation working faces, which has a large labor, a large excavation amount, a long excavation time and a high excavation cost, and the alternation between the coal mining and the excavation is tense. Inside the mining areas, for each of the working faces, it is required to excavate out in advance two laneways as a working-face haulageway and a working-face return airway, to serve each of the working faces. The tremendous workload of the excavation causes an extremely long time for the early-stage preparation of coal production, increases the cost of coal production, and wastes a large amount of time and money, and safety accidents frequently happen during the laneway excavation.

Moreover, protecting coal pillars with certain widths are required to be left between the neighboring working faces. The coal-pillar leaving causes a huge waste of the coal resource, and, with the increasing of the mining depth, geological disasters such as large deformation of the laneway wall rock, rock burst, coal (rock) explosion, and coal and gas outburst caused by stress concentration over the left coal pillars are very serious.

In conclusion, the coal mining in the prior art requires a large excavation amount, a long excavation time and a high excavation cost, and the coal-pillar leaving causes a huge waste of the coal resource.

SUMMARY

The embodiments of the present disclosure provide a coal mining method without coal-pillar leaving and without laneway excavation in a full mining area, to solve the problems in the prior art that coal mining requires a large excavation amount, a long excavation time and a high excavation cost, and the coal-pillar leaving causes a huge waste of the coal resource.

In order to solve the above technical problems, the present disclosure provides a coal mining method, wherein the method comprises the steps of:

drilling a main shaft, an auxiliary shaft and a return air shaft from a ground to a coal mining layer;

after the main shaft, the auxiliary shaft and the return air shaft have been drilled to the coal mining layer, arranging a working-face production system at the coal mining layer;

exploiting by using a coal mining machine cutting a coal wall in a first direction, to form a first mining face with the first direction as an advance direction;

by the coal mining machine, cutting out a first haulageway and a first return airway while cutting the coal wall at the first mining face, and preserving the first haulageway and the first return airway, wherein the first haulageway and the first return airway are located on two sides of the first mining face, the first haulageway is in communication with both of the main shaft and the auxiliary shaft, and the first return airway is in communication with the return air shaft;

after the first mining face has been mined to a mining stopping line, leaving a reserved laneway of the first mining face at an end of the first mining face, wherein the reserved laneway of the first mining face is in communication with the first haulageway and the first return airway;

after the coal mining at the first mining face has been completed, by using the first haulageway or the first return airway of the first mining face as an open-off cut of a second working face, exploiting at the second working face in a second direction further away from the first haulageway or the first return airway; and by the coal mining machine, cutting out a second haulageway and a second return airway while cutting a coal wall at the second working face, and preserving the second haulageway and the second return airway, wherein the second haulageway and the second return airway are located on two sides of the second working face, the second haulageway is in communication with the first haulageway, and the second return airway is in communication with the return air shaft.

Optionally, the second working face is a plurality of second working faces, the plurality of second working faces are sequentially exploited, and, starting from the exploitation of a second of the plurality of second working faces, the second return airway of a previous one of the plurality of second working faces is located on one side closer to a next one of the plurality of second working faces, and the second return airway of the previous one of the plurality of second working faces is used as the second haulageway of the next one of the plurality of second working faces.

Optionally, the second working face is exploited from one side of the first mining face that is located at the first haulageway.

Optionally, the second working face is exploited from one side of the first mining face that is located at the first return airway.

Optionally, the second direction is perpendicular to the first direction.

Optionally, the method further comprises, after the second working face has been mined to a mining stopping line, leaving a working-face reserved laneway at an end of the second working face, wherein the working-face reserved laneway is in communication with the second haulageway and the second return airway.

Optionally, the first haulageway and the first return airway are formed by using a technique of roof-cutting pressure-relieving lane self-formation.

Optionally, the second haulageway and the second return airway are formed by using a technique of roof-cutting pressure-relieving lane self-formation.

Optionally, the return air shaft and the main shaft are a same one mineshaft.

Optionally, the return air shaft and the auxiliary shaft are a same one mineshaft.

By using the technical solutions of the present disclosure, no laneway is excavated in the entire mining area, which can eliminate the excavation, reduce the time of the early-stage preparation of coal production, and advance the time of coal exploitation. Moreover, the present disclosure reduces the cost of coal production, reduces the personnel required by excavation, prevents safety accidents caused by laneway excavation, and saves a large amount of time and money for the entire pit production. No coal pillar is left in the entire mining area, which can increase the output rate of the pit, save the coal resource, prolong the service life of the pit, prevent geological disasters such as large deformation of the laneway wall rock, rock burst, coal (rock) explosion, and coal and gas outburst caused by stress concentration over the left coal pillars, and make a huge contribution to the saving of the coal resource.

Figure 1:
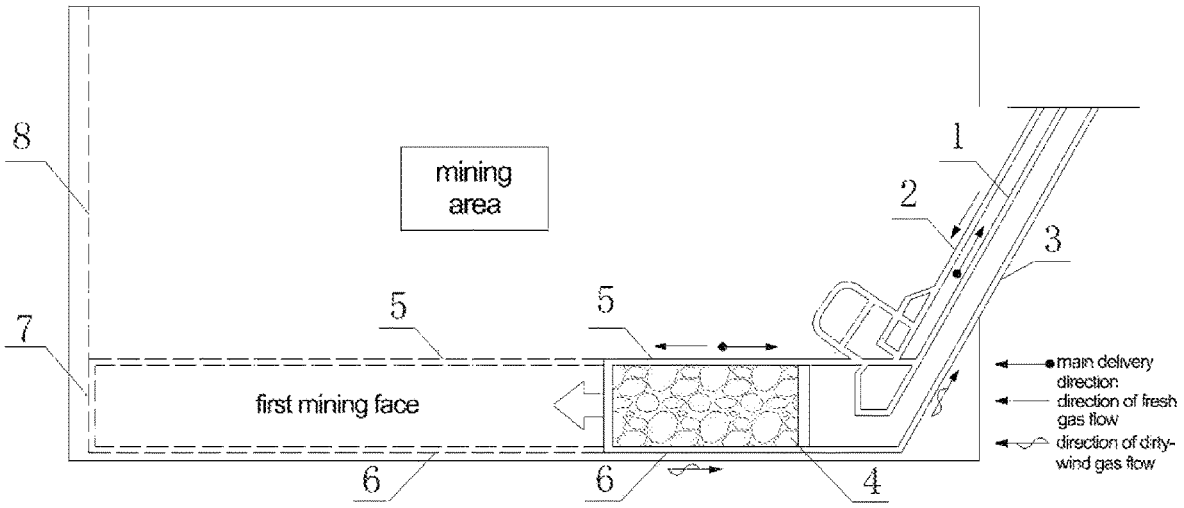
FIG. 1 is a schematic diagram of the first mining face in the mining-area coal mining operation of the coal mining method according to an embodiment of the present disclosure.

The reference numbers in the drawings are as follows:

1. main shaft; 2. auxiliary shaft; 3. return air shaft; 4. first mining face; 5. first haulageway; 6. first return airway; 7. reserved laneway; 8. mining stopping line; 9. second working face; 10. second haulageway; 11. second return airway; 12. mining stopping line; 13. working-face reserved laneway; 901. first exploiting face; and 902. second exploiting face.

DETAILED DESCRIPTION

The present disclosure will be further described in detail below with reference to the drawings and the particular embodiments, which are not intended to limit the present disclosure.

Referring to FIG. 1, according to an embodiment of the present disclosure, there is provided a coal mining method without coal-pillar leaving and without laneway excavation in a full mining area. The coal mining method comprises the steps of:

drilling a main shaft 1, an auxiliary shaft 2 and a return air shaft 3 from the ground to a coal mining layer;

after the main shaft 1, the auxiliary shaft 2 and the return air shaft 3 have been drilled to the coal mining layer, arranging a working-face production system at the coal mining layer;

excavating by using a coal mining machine cutting a coal wall in a first direction, to form a first mining face 4 with the first direction as the advance direction;

by the coal mining machine, cutting out a first haulageway 5 and a first return airway 6 while cutting the coal wall at the first mining face 4, and preserving the first haulageway 5 and the first return airway 6, wherein the first haulageway 5 and the first return airway 6 are located on the two sides of the first mining face 4, the first haulageway 5 is in communication with both of the main shaft 1 and the auxiliary shaft 2, and the first return airway 6 is in communication with the return air shaft 3;

after the first mining face 4 has been mined to a mining stopping line 8, leaving a reserved laneway 7 of the first mining face 4 at the end of the first mining face 4, wherein the reserved laneway 7 of the first mining face 4 is in communication with the first haulageway 5 and the first return airway 6;

after the coal mining at the first mining face 4 has been completed, by using the first haulageway 5 or the first return airway 6 of the first mining face as an open-off cut of a second working face 9, exploiting at the second working face 9 in a second direction further away from the first haulageway 5 or the first return airway 6; and by the coal mining machine, cutting out a second haulageway 10 and a second return airway 11 while cutting a coal wall at the second working face 9, and preserving the second haulageway 10 and the second return airway 11, wherein the second haulageway 10 and the second return airway 11 are located on the two sides of the second working face 9, the second haulageway 10 is in communication with the first haulageway 5, and the second return airway 11 is in communication with the return air shaft 3.

In the coal mining method without coal-pillar leaving and without laneway excavation in a full mining area according to the present disclosure, according to the mode of the distribution of the first mining face and the second working face, the whole coal bed can be extensively excavated. Therefore, as compared with the prior art, in which a large quantity of laneways are exploited in a stable terrane, a large amount of excavation workload is saved, all of the excavation operations are effective excavation in the coal bed, and the haulageway and the return airway that are left can be used directly, which effectively reduces the cost on the laneway excavation. Furthermore, the haulageway and the return airway are formed inside the coal bed, the haulageway and the return airway can be formed by roof-cutting pressure relieving, and the technique has been very mature, whereby a large amount of coal-pillar leaving is not required, which in turn solves the problem in the prior art that the exploitation of coal mines causes a large amount of waste of the coal resource.

After the second working face 9 has been mined to a mining stopping line 12, a working-face reserved laneway 13 at the end of the second working face 9 is left, wherein the working-face reserved laneway 13 refers to a gob-side entry retaining at the end of the second working face 9, and the working-face reserved laneway 13 is in communication with the second haulageway 10 and the second return airway 11.

It should be noted that the first haulageway 5 and the first return airway 6 are formed by using the technique of roof-cutting pressure-relieving lane self-formation. The second haulageway 10 and the second return airway 11 are formed by using the technique of roof-cutting pressure-relieving lane self-formation.

Figure 2:
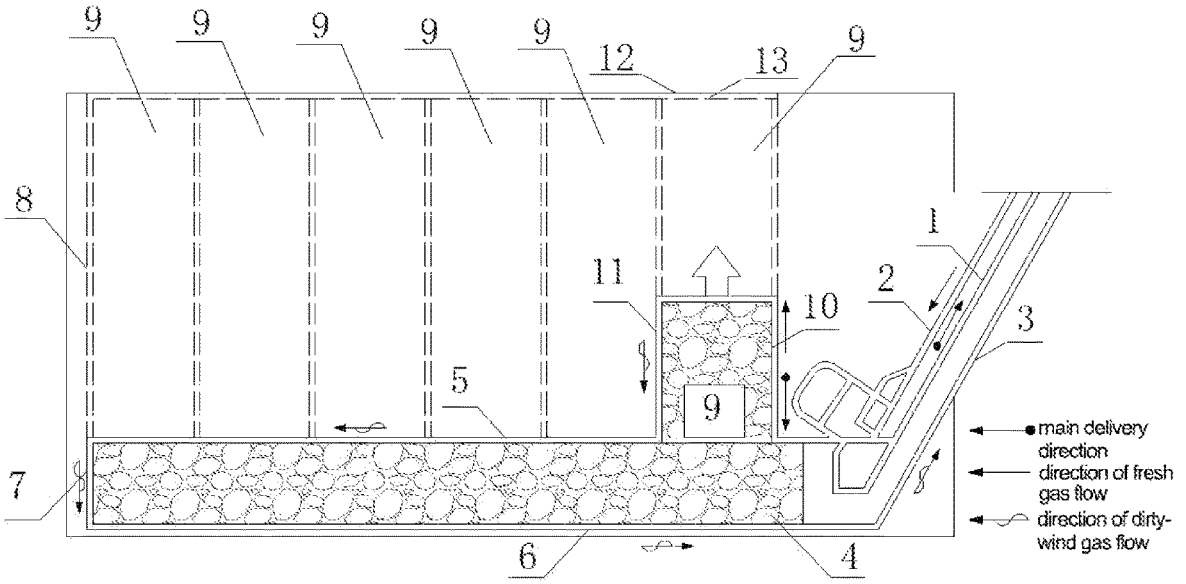
FIG. 2 is a schematic diagram of the second working face in the mining-area coal mining operation of the coal mining method according to an embodiment of the present disclosure.
Figure 3:
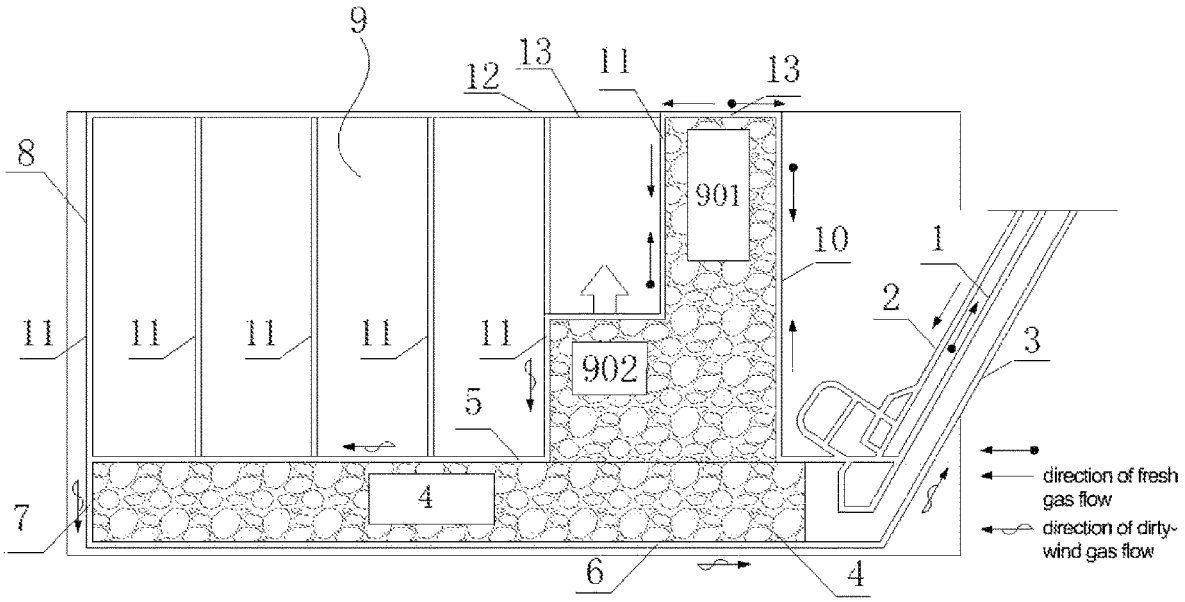
FIG. 3 is a schematic diagram of the second exploiting face of the second working face in the mining-area coal mining operation of the coal mining method according to an embodiment of the present disclosure.

The second working face 9 is a plurality of second working faces, the plurality of second working faces are sequentially exploited, and, starting from the exploitation of a second of the plurality of second working faces, the second return airway of a previous one of the plurality of second working faces is located on one side closer to a next one of the plurality of second working faces, and the second return airway of the previous one of the plurality of second working faces is used as the second haulageway of the next one of the plurality of second working faces. Referring to FIG. 2, a plurality of the second working faces are arranged sequentially in the first direction, and the second working faces are exploited sequentially in the direction shown in FIG. 2 from right to left. Furthermore, the useless haulageway that is left from the previous one working face is discarded when being exploited, as shown in FIG. 3.

Furthermore, the second working face 9 is exploited from one side of the first mining face 4 that is located at the first haulageway 5, wherein the second direction is perpendicular to the first direction. By using the cooperation between the first direction and the second direction of the first mining face, all of the coal mines in the mining area can be exploited out, which prevents incomplete coal mining to the largest extent, and increases the coal output.

Figure 4:
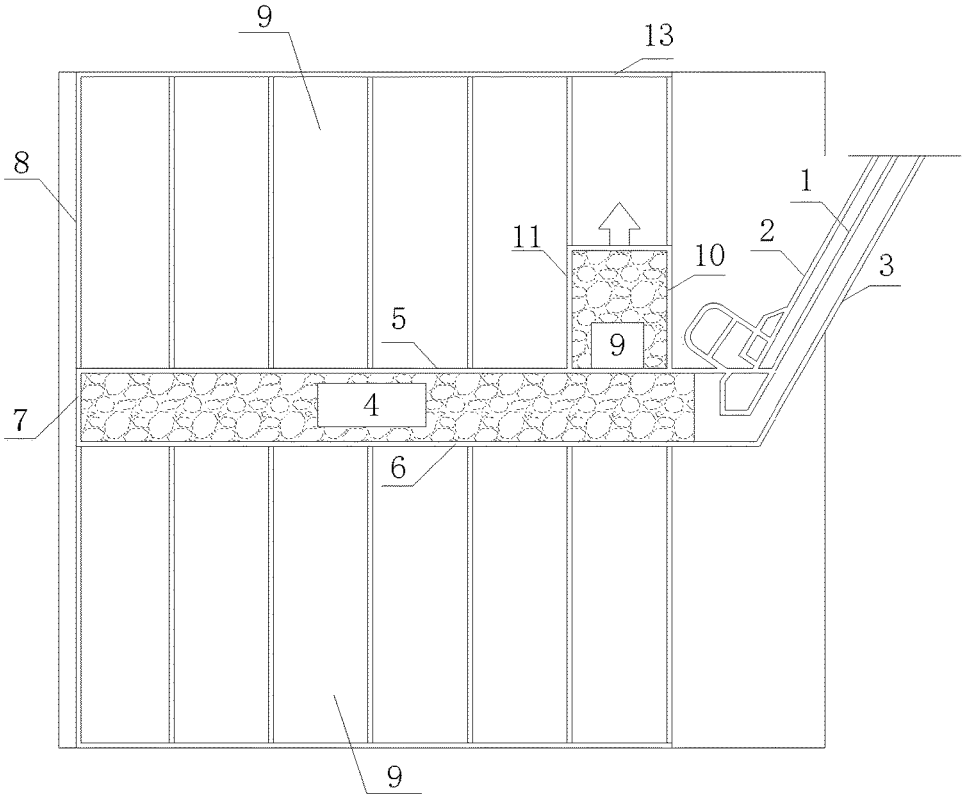
FIG. 4 is a schematic diagram of the layout of the second working face in the mining-area coal mining operation of the coal mining method according to an embodiment of the present disclosure.

In addition, referring to FIG. 4, the second working face 9 is exploited from one side of the first mining face 4 that is located at the first return airway 6. Furthermore, the second working face 9 may be exploited from the two sides (the side of the first haulageway 5 and the side of the first return airway 6) of the first mining face 4 simultaneously, which has a higher exploitation efficiency. Certainly, it may be firstly exploited from one side of the first mining face 4, and then be exploited from the other one side. For example, in the direction opposite to that shown in FIG. 4, firstly a plurality of working faces of the second working faces is exploited from right to left, and, after the mining stopping line has been reached, the second working faces on the other one side are exploited from left to right.

The operating process of the coal mining method will be explained in detail with reference to the drawings:

Referring to FIG. 1, at a certain coal mine, according to the deposit condition of the coal bed and the well system, the main shaft 1, the auxiliary shaft 2 and the return air shaft 3 are arranged, and all of the main shaft 1, the auxiliary shaft 2 and the return air shaft 3 lead directly to the mined coal bed. The main shaft 1 and the auxiliary shaft 2 are on one side, and the return air shaft 3 is on the other side. The main shaft 1 is used to deliver the coal, and the auxiliary shaft 2 is used to ascend and descend the materials or the personnel. After the coal bed has been reached, firstly an open-off cut of the first mining face is excavated out, and then the production system is arranged at the open-off cut. The coal wall is cut by using a coal mining machine, to directly cut out the first haulageway 5 and the first return airway 6 of the first mining face. Subsequently, by using the technique of roof-cutting pressure-relieving lane self-formation (automatically forming the laneway by the falling of the roof of the goaf), the first haulageway 5 and the first return airway 6 are preserved. The mining stopping line 8 of the first mining face 4 is the boundary line of the mining area. When the first mining face has been exploited to the mining stopping line 8, simultaneously with the support removing, by using the technique of roof-cutting pressure-relieving lane self-formation, a reserved laneway 7 of the first mining face 4 is left at the end of the first mining face 4, to, together with the first haulageway 5 and the first return airway 6, form a complete coal mining system and ventilation system.

The coal mining system: after the coal mining at the working face, the coal is delivered to the first haulageway 5→the main shaft 1→the ground.

The ventilation system: a fresh air flow is delivered from the main shaft 1 and the auxiliary shaft 2→the first haulageway 5→the working face (changing into a dirty air)→the first return airway 6→the return air shaft 3→the ground.

Referring to FIG. 2, after the first mining face has ended, the open-off cut and the production system are arranged into the laneway left by the first mining face in a second direction perpendicular to the first direction. The methods of exploitation and lane leaving of the second working face are the same as those of the first mining face, with the lanes left during the exploitation. The coal mining machine cuts out the second haulageway 10 and the second return airway 11 while cutting the coal wall. The second haulageway 10 and the second return airway 11 of the second working face 9 are preserved. After the second working face has been exploited to the mining stopping line 12 of the second working face, the working-face reserved laneway 13 is preserved by using the technique of roof-cutting pressure-relieving lane self-formation, and, together with the second haulageway 10, the second return airway 11, the reserved laneway 7, the first haulageway 5 and the first return airway 6, forms the complete coal mining system and return air system of the entire mining area.

The coal mining system: the coal mined at the second working face the second haulageway 10 left by the second working face→the first haulageway 5→the main shaft 1→the ground.

The ventilation system: a fresh air flow, from the main shaft 1 and the auxiliary shaft 2, enters the first haulageway 5→the second haulageway 10→the second working face (changing into a dirty air)→the second return airway 11→the first haulageway 5→the reserved laneway the first return airway 6→the return air shaft 3→the ground.

Referring to FIG. 3, after the second working face has been exploited to the mining stopping line and the working-face reserved laneway 13 is preserved, complete coal mining system and delivering system of the second working face are formed. Immediately, the open-off cut and the exploiting system are arranged directly at the neighboring position of the next second working face. In the exploitation of that face, the coal mining machine cuts the coal wall, wherein merely the second return airway of the working face is required to be cut out, and the haulageway is not required to be cut out. Because the second return airway 11 of the previous second working face is left, and directly serves as the haulageway of the next second working face. With the advancement of the second working face, the second haulageway of the second working face (the return airway of the previous second working face) is accordingly discarded, i.e., discarded during the exploitation. At the same time, the working-face reserved laneway 13 is left at the mining stopping line. The working-face reserved laneways 13 of the plurality of second working faces are in communication with each other, and all of the working-face reserved laneways 13 are at the same time in communication with the second haulageways 10 and the second return airways 11 left by the second working faces, and the working-face reserved laneway 13, the second haulageway 10, the second return airway 11, the reserved laneway 7, the first haulageway 5 and the first return airway 6 together form the complete coal mining system and ventilation system (some of the laneways are not only the laneway of the coal mining system but also the laneway of the ventilation system). In order to facilitate the description on the sequential exploitation of the second working faces, the plurality of second working faces 9 are named, according to the exploitation order, as a first exploiting face 901, a second exploiting face 902 to an N-th exploiting face. Furthermore, the coal mining system and the return air system are described by using the first exploiting face 901 and the second exploiting face 902 as follows:

The coal mining system: the coal mined at the second exploiting face 902→the second return airway 11 left by the first exploiting face 901→the working-face reserved laneway 13 left by the first exploiting face 901→the second haulageway 10 left by the first exploiting face 901→the first haulageway 5→the main shaft 1→the ground.

The return air system: a fresh air flow, via the main shaft 1 and the auxiliary shaft 2, flows into the first haulageway 5→the second haulageway 10 left by the first exploiting face 901→the working-face reserved laneway 13 of the first exploiting face 901→the second return airway 11 left by the first exploiting face 901→the second exploiting face 902 (changing into a dirty air)→the second return airway 11 of the second exploiting face 902→the first haulageway 5→the reserved laneway 7→the first return airway 6→the return air shaft 3→the ground.

Referring to FIG. 4, when the mining area is large, in order to increase the utilization ratio of the two laneways of the first mining face, so as to increase the operation coverage area of the two laneways of the first mining face, after the exploitation at the side of the first mining face at the first haulageway 5 has been completed, the open-off cut may be arranged at the first return airway 6 of the first mining face, to exploit the mining area at the side of the first return airway 6. The modes of the exploitation and the lane leaving are the same as the modes of the exploitation and the lane leaving of the second working face, and the rest may be done in the same manner, so as to increase the utilization ratio of the two laneways of the first mining face, to increase the operation coverage area of the two laneways of the first mining face. Certainly, the exploitation may also be performed simultaneously on the two sides of the first haulageway 5 and the first return airway 6, which can effectively increase the exploitation efficiency.

Figure 5:
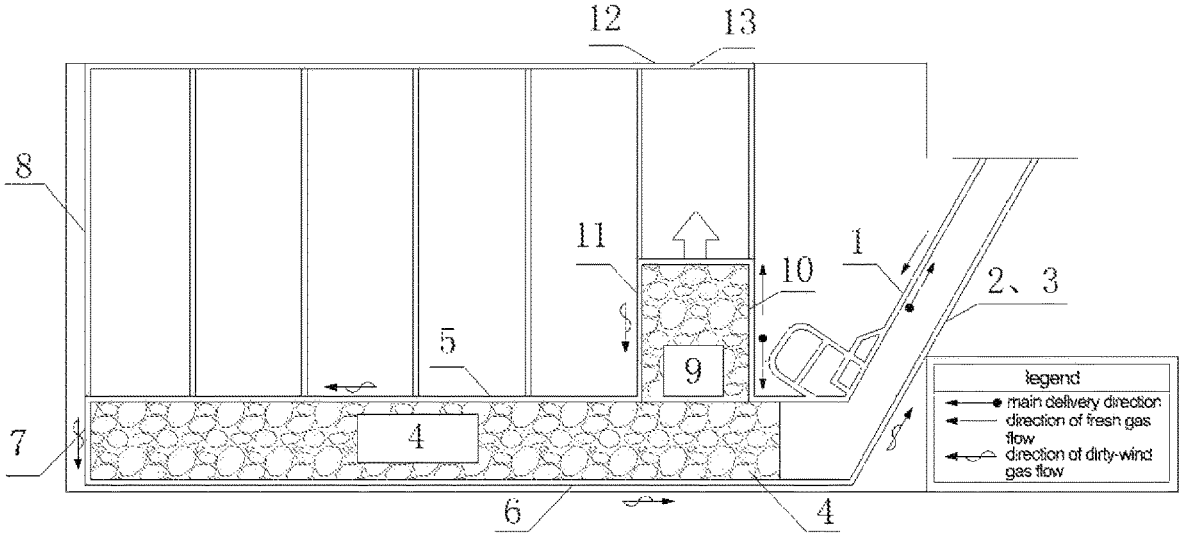
FIG. 5 is a schematic diagram of the first mining face in the mining-area coal mining operation of the coal mining method according to another embodiment of the present disclosure.

Referring to FIG. 5, the present disclosure further provides an embodiment of a coal mining method, in which the coal mining method is substantially the same as the implementation steps of the above embodiments, and the mere difference is the arrangement of the main shaft, the auxiliary shaft and the return air shaft, in which the return air shaft and the main shaft are the same one mineshaft or the return air shaft and the auxiliary shaft are the same one mineshaft. The air flow flowing through the return air shaft may directly flow from the main shaft or the auxiliary shaft.

As compared with the prior art, the present disclosure has the following advantageous effects:

(1) No laneway is excavated in the entire mining area, which can eliminate the excavation, reduce the time of the early-stage preparation of coal production, and advance the time of coal exploitation. Moreover, the present disclosure reduces the cost of coal production, reduces the personnel required by excavation, prevents safety accidents caused by laneway excavation, and saves a large amount of time and money for the entire pit production.

(2) No coal pillar is left in the entire mining area, which can increase the output rate of the pit, save the coal resource, prolong the service life of the pit, prevent geological disasters such as large deformation of the laneway wall rock, rock burst, coal (rock) explosion, and coal and gas outburst caused by stress concentration over the left coal pillars, and make a huge contribution to the saving of the coal resource.

It should be noted that the terms used herein are merely for the description on the particular embodiments, and are not intended to limit the exemplary embodiments of the present application. As used herein, unless explicitly stated otherwise in the context, the terms in the singular forms are intended to encompass the plural forms. Furthermore, it should also be understood that, when the term "comprise" and/or "include" is used in the description, it indicates the existence of a feature, a step, a process, a device, a component and/or a combination thereof.

It should be noted that the terms "first", "second" and so on in the description, the claims and the drawings of the present application are intended to distinguish similar objects, and are not necessarily used to describe a particular order or sequence. It should be understood that the data so used may be interchanged in suitable cases, whereby the embodiments of the present application described herein can be implemented in other sequences than those illustrated or described herein.

Certainly, the above are preferable embodiments of the present disclosure. It should be noted that a person skilled in the art may make various improvements without departing from the basic principle of the present disclosure, wherein those improvements are considered as falling within the protection scope of the present disclosure.

The invention claimed is:

1. A coal mining method, wherein the method comprises:

drilling a main shaft, an auxiliary shaft and a return air shaft from a ground to a coal mining layer;

after the main shaft, the auxiliary shaft and the return air shaft have been drilled to the coal mining layer, arranging a working-face production system at the coal mining layer;

exploiting by using a coal mining machine cutting a coal wall in a first direction, to form a first mining face with the first direction as an advance direction;

by the coal mining machine, cutting out a first haulageway and a first return airway while cutting the coal wall at the first mining face, and preserving the first haulageway and the first return airway, wherein the first haulageway and the first return airway are located on two sides of the first mining face, the first haulageway is in communication with both of the main shaft and the auxiliary shaft, and the first return airway is in communication with the return air shaft;

after the first mining face has been mined to a mining stopping line, leaving a reserved laneway of the first mining face at an end of the first mining face, wherein the reserved laneway of the first mining face is in communication with the first haulageway and the first return airway;

after the coal mining at the first mining face has been completed, an open-off cut of a second working face is arranged in the first haulageway or the first return airway of the first mining face, exploiting at the second working face in a second direction perpendicular to the first direction in a way further away from the first haulageway or the first return airway; and by the coal mining machine, cutting out a second haulageway and a second return airway while cutting a coal wall at the second working face, and preserving the second haulageway and the second return airway, wherein the second haulageway and the second return airway are located on two sides of the second working face, the second haulageway is in communication with the first haulageway, and the second return airway is in communication with the return air shaft.

2. The coal mining method according to claim 1, wherein the second working face is a plurality of second working faces, the plurality of second working faces are sequentially exploited, and, starting from the exploitation of a second of the plurality of second working faces, the second return airway of a previous one of the plurality of second working faces is located on one side closer to a next one of the plurality of second working faces, and the second return airway of the previous one of the plurality of second working faces is used as the second haulageway of the next one of the plurality of second working faces.

3. The coal mining method according to claim 1, wherein the second working face is exploited from one side of the first mining face that is located at the first haulageway.

4. The coal mining method according to claim 1, wherein the second working face is exploited from one side of the first mining face that is located at the first return airway.

5. The coal mining method according to claim 1, wherein the second direction is perpendicular to the first direction.

6. The coal mining method according to claim 1, wherein the method further comprises, after the second working face has been mined to a mining stopping line, leaving a working-face reserved laneway at an end of the second working face, wherein the working-face reserved laneway is in communication with the second haulageway and the second return airway.

7. The coal mining method according to claim 1, wherein the first haulageway and the first return airway are formed by using a technique of roof-cutting pressure-relieving lane self-formation.

8. The coal mining method according to claim 1, wherein the second haulageway and the second return airway are formed by using a technique of roof-cutting pressure-relieving lane self-formation.

* * * * *